US006746576B2

(12) United States Patent
Halmschlager et al.

(10) Patent No.: US 6,746,576 B2
(45) Date of Patent: Jun. 8, 2004

(54) METHOD AND ARRANGEMENT FOR ATTACHING AT LEAST ONE SHAPED PART TOGETHER WITH A WEAR PART ONTO A SUPPORT PIECE

(75) Inventors: Günter Halmschlager, Krems (AT); Franz Stelzhammer, Böheimkirchen (AT); Christoph Haase, Neulengbach (AT); Rüdiger Keinberger, Aigen (AT); Rudolf Simmel, Oepping (AT); Johann Leitner, Aigen (AT)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/997,026

(22) Filed: Nov. 20, 2001

(65) Prior Publication Data

US 2002/0060041 A1 May 23, 2002

(30) Foreign Application Priority Data

Nov. 21, 2000 (DE) ..... 100 57 553

(51) Int. Cl.[7] ..... D21F 1/36
(52) U.S. Cl. ..... 162/352; 162/374
(58) Field of Search ..... 162/352, 374, 162/199

(56) References Cited

U.S. PATENT DOCUMENTS

| | | | | | |
|---|---|---|---|---|---|
| 3,337,394 | A | * | 8/1967 | White et al. | 162/352 |
| 3,535,204 | A | * | 10/1970 | Truxa | 162/352 |
| 3,576,716 | A | * | 4/1971 | Reynolds et al. | 162/352 |
| 3,922,190 | A | * | 11/1975 | Cowan | 162/352 |
| 3,953,284 | A | * | 4/1976 | Evalahti | 162/352 |
| 4,088,531 | A | * | 5/1978 | Lamminen | 162/352 |
| 4,319,957 | A | | 3/1982 | Bartelmuss | 162/352 |
| 4,559,105 | A | * | 12/1985 | Sennett et al. | 162/352 |
| 5,486,270 | A | * | 1/1996 | Schiel | 162/352 |
| 6,039,843 | A | * | 3/2000 | Wight | 162/352 |
| 6,379,503 | B1 | * | 4/2002 | Jansson | 162/352 |

FOREIGN PATENT DOCUMENTS

| | | | |
|---|---|---|---|
| DE | 1 761 174 | 6/1971 | |
| DE | 37 17 532 A1 | 12/1987 | D21F/1/48 |
| DE | 43 19 311 A1 | 12/1994 | F16B/11/00 |
| DE | 4319311 | 12/1994 | F16B/11/00 |
| WO | WO 93/00473 | 1/1993 | D21F/1/48 |
| WO | WO 00/22229 | 4/2000 | D21F/1/48 |

* cited by examiner

*Primary Examiner*—Peter Chin
(74) *Attorney, Agent, or Firm*—Taylor & Aust, P.C.

(57) ABSTRACT

The arrangement is for use within a machine for at least one of making and processing at least one of paper, cardboard and tissue. The arrangement includes a first unit, a support piece and at least one clamping device. A first unit has a shaped part together with a wear part, the shaped part having a part underside. The part underside has an underside length, the shaped part displaying a part contour upon the part underside along substantially all of the underside length. A support piece interlocks with the shaped part, the support piece having a support piece top and a corresponding top length. The support piece has a piece contour upon the support piece top along substantially all of the top length, the piece contour being substantially complimentary to the part contour. At least one clamping device is operatively positioned relative to both the part contour and the piece contour.

50 Claims, 4 Drawing Sheets

METHOD AND ARRANGEMENT FOR ATTACHING AT LEAST ONE SHAPED PART TOGETHER WITH A WEAR PART ONTO A SUPPORT PIECE

BACKGROUND OF THE INVENTION

1. Field of the Invention

The present invention relates to a method for attaching at least one shaped part, together with a wear part onto a support piece and to an arrangement for mounting at least one shaped part which is equipped with a wear part, onto a support piece.

2. Description of the Related Art

An arrangement of this type is known from the German prior art document DE-OS 1 761 174, which discloses the mounting of an oxide ceramic strip (shaped part/wear part) to a strip shaped support (support piece). The support piece may be manufactured from metal or a hydrophobic, deformation resistant synthetic material such as sintered low-pressure polyethylene. The oxide ceramic strip is longitudinally movable and flexible for expansion and is equipped for this purpose with a longitudinal groove extending along the entire length thereof. The groove enlarges toward the inside to a T-shaped cross section. The support is provided with several longitudinal slots distributed along its length, whose orientation is in a longitudinal direction. The longitudinal slots intersperse the support from its flat cover surface on which the floor area of the oxide ceramic strip rests, through to a longitudinal groove on the floor area of the support. A screw intended for securing the oxide ceramic strip on the support can slide in each longitudinal slot. The oxide ceramic strip has profile flanges which point toward the inside. A shim facilitates the screw head resting on such profile flanges. A nut is fastened onto the screw, whereby the nut with the help of springy shims, for example two Belleville washers, supports itself on a shim which rests on the oxide ceramic strip. If the oxide ceramic strip expands differently than the support, then the screws glide in the longitudinal slots, a process further facilitated by the springy shims. Since the fastening elements which secure the oxide ceramic strip on the support engage the oxide ceramic strip from the bottom, the surface of the oxide ceramic strip interacting with the wire and felts remains completely smooth, thereby neither increasing the friction resistance nor causing countersink holes for the fastening screws in the surface in which stock particles could accumulate.

A disadvantage of this arrangement including fastening elements (for example, screws) is, that the fastening elements may loosen during operation and, in a worst case scenario, may independently detach themselves. A detached fastening element may get into the processing zones of the paper, cardboard or tissue machine and may cause considerable damage, resulting in a forced shut-down of the machine and possibly in expensive repairs.

Further, such replacement of the wear part together with the shaped part results in longer down times because of the multitude of fastening elements which would normally require unscrewing, tightening and securing. Furthermore, an easy change-over of the wear part, together with the shaped part, is not possible from the machine side since the fasteners are mounted at more or less equal distances in the CD (cross-machine direction) direction and must be actuated at their installation locations.

Existing arrangements are already known from the PCT document WO 93/00473 and the two German documents DE 43 19 311 A1 and DE 37 17 532 A1 in which the shaped part is held and fastened by a dovetail connection, a T-groove connection or a cross connection in the support piece.

Because of the required manufacturing tolerances on the one hand, and the required clearances between the shaped part and the support piece on the other hand various problems can occur. A fit which is too tight makes the mounting of the shaped part more difficult and makes it impossible to slide the long shaped part onto the support piece. Many times, disassembly of a shaped part with too tight a clearance is not possible without destroying the wear piece mounted on it. On the other hand, too much clearance between the shaped part and the support piece leads to wobbling of the shaped part on the support piece, resulting in that no defined dewatering geometry (e.g., foil angle) can be adhered to. Furthermore, too large a clearance may cause vibration of the parts which, in the area of the former, may lead to formation problems in the material web which is to be formed.

SUMMARY OF THE INVENTION

It is therefore the objective of the invention to improve a method and an arrangement of mounting at least one shaped part, which is equipped with a wear part, onto a support piece in such a way that the aforementioned disadvantages of the state of the art are avoided. A prime aspect is the realization of an improved cost-effectiveness ratio. With respect to the method of the present invention, two parts are clamped to each other by a clamping device so that an operating tolerance is vastly or preferably totally eliminated based on manufacturing tolerances; and a quick and non-destructive change-over of the shaped part is possible; and a common sealing of the two parts (support piece and shaped part) by the clamping device on the one hand and a positive locking of the two parts on the other hand provides that neither fiber-loaded nor dirt-loaded processing water can penetrate between them. This type of clamping provides an excellent way of realizing the advantages of increased effective operating time, a defined and constant dewatering geometry and low change-over times.

Furthermore, clamping is achieved by the clamping device in a manner whereby vibrations are eliminated and the clamping becomes oscillation damping, whereby a "softer" and low-noise machine operation is achieved.

A defined and constant dewatering geometry is also facilitated if clamping by the clamping device is achieved in a manner whereby the foil angle during clamping is not changed.

From a statistical point of view, it is advantageous if clamping is achieved so that, in addition to the clamping device's clamping line, at least two additional defined support lines ensure clear positioning between support piece and shaped part.

With respect to the apparatus of the present invention, the shaped part displays a contour, specifically an inside contour extending along the entire length of the under side thereof, this contour is essentially complimentary to the outside contour extending along the entire length on the top of the support piece, and a preferably operable clamping device is provided in the area of the two complimentary contours.

The clamping device provides that the two parts are definitively and permanently clamped to each other, whereas the complementing contours provide that, even in the event of a clamping device malfunction, the basic operation thereof is maintained, so that there is no increased danger of wire and/or felt destruction.

In a first embodiment of the invention, on the first side, the shaped part has a 2-part T-groove as an inside contour and on the second side has a 2-part dovetail groove as an inside contour; and on the first side the support piece has a 2-part T-rib as an outside contour and on the second side has a 2-part dovetail rib as an outside contour; and the clamping device is located in the area of the angled 2-part dovetail contour.

In a second embodiment of the invention, the shaped part has a T-groove as an inside contour, preferably with a recess in the groove bottom; the support piece has a T-rib as an outside contour; and the clamping device is mounted preferably in the center in the area of the grooved bottom.

In a third embodiment of the invention, the shaped part has a T-groove as an inside contour, preferably with a recess at the groove bottom; the support part has a T-rib as an outside contour; and the clamping device is mounted preferably centered on the T-rib and will act upon the T-groove, preferably in the area of the groove bottom.

In a fourth embodiment of the invention, the shaped part has a dovetailed groove, equipped with a parallel base as an inside contour, preferably with a recess in the grooved bottom; the support piece has a dovetailed rib with a parallel base as an outside contour; and a clamping device is installed on each side of the angled dovetailed contours.

In a fifth embodiment of the invention, the shaped part has a T-groove as an inside contour, preferably with a recess in the grooved bottom; the support piece has a T-rib as an outside contour; and a clamping device is installed on each side in the area of the two opposing short face surfaces (clamping at bottom).

In a sixth embodiment of the invention, the shaped part has a T-groove as an inside contour, preferably with a recess in the grooved bottom; the support piece has a T-rib with clamping rail as an outer contour, and the clamping device is installed between the T-rib of the support piece and the clamping rail, integrated preferably in a V-groove which is centered preferably on the T-rib.

In a seventh embodiment of the invention, the shaped part has a T-groove as an inside contour; the support piece has a T-rib as an outside contour; and at least one clamping device is installed between the top side of the T-rib and the grooved bottom.

In an eighth embodiment of the invention, the shaped part has a T-groove as an inside contour, preferably with a recess in the grooved bottom; the support piece has a T-rib with two side bevels progressing from the T-rib bottom toward the outside and with a parallel base; and a clamping device is installed in the areas of each of the two bevels.

In a ninth embodiment of the invention, the shaped part has a dovetail groove as an inside contour, preferably with a recess in the groove bottom; the support piece has a dovetail rib as an outside contour; and the clamping device is installed preferably centered in the area of the groove bottom.

In a tenth embodiment of the invention, the shaped part has a T-groove as an inside contour, preferably with a recess in the grooved bottom; the support piece has a T-rib as an outside contour; and a clamping device is installed in the area of each of the two opposing short face areas (clamping on top).

In an eleventh embodiment of the invention, the shaped part has a T-groove as an inside contour, whereby the T-groove has a recess in the grooved bottom; the support piece has a T-rib as an outside contour; and the clamping device is installed in the recess in the groove bottom.

In a twelfth embodiment of the invention, the shaped part has a dovetail groove as an inside contour; the support piece has a dovetail rib as an outside contour; and at least one pivoting clamping device, located primarily in the support piece, is installed in the area of the dovetail contours which are angled on both sides.

In a thirteenth embodiment of the invention, the shaped part has a dovetail groove as an inside contour; the support piece has a dovetail rib as an outside contour; and at least one expansive clamping device, located primarily in the support piece, is installed in the area of the dovetail contours which are angled on both sides.

This embodiment has already proven itself successful in trials. This design successfully prevented penetration of dirt into the clamping device; easy unclamping was made possible by only one rubber tube; optimum and safe clamping was achieved through the wedge effect; the damping rubber tube permitted only slight vibrations; and production, due to only one-sided loading for the rubber tube, turned out to be relatively cost effective.

Total avoidance of dirt penetration into the clamping device is achieved in that the mutual sealing of the two parts (support piece and shaped part) is achieved by the clamping device, specifically an elastomer tube on the one hand and positive locking of the two parts on the other hand. Due to this sealing, neither fiber-loaded nor dirt-loaded processing water can penetrate.

In a fourteenth embodiment of the invention, the shaped part has a T-groove as an inside contour; the support piece has a T-rib as an outside contour which is beveled on one side, progressing from the T-rib bottom toward the outside; and the clamping device is installed in the area of the bevel.

In a fifteenth embodiment of the invention, the shaped body has a T-groove as an inside contour; the support piece has a T-rib as an outside contour which on one side has a shorter root face; and the clamping device is installed in the area of the shorter root face.

All fifteen described embodiments of the invention solve the objective in an excellent manner. The shaped part and the support piece are geometrically defined and permanently clamped to each other. The clamping device is integrated into the internal area of the two parts and the cost effectiveness ratio is improved.

The clamping device in the design according to the invention is, in a first embodiment thereof, an eccentric with associated operating device, whereby the operating device can be, for example, an eccentric disk or an electric motor. Advantages of this embodiment are the low design considerations and the low acquisition and operating costs for the clamping device.

A second embodiment of the clamping device includes an elastomer tube with a certain operating pressure, generally between 0.5 bar and 5 bar, preferably between 2 bar and 3.5 bar. The elastomer tube offers the advantage of a clamping device that is subject to operating wear and tear only in small measures. Design considerations and acquisition costs are low also in this instance.

In accordance with the invention, the operating pressure is produced by a preferably central pressure source, including a control system. Furthermore, the pressure source serves at least one clamping connection (preferably all clamping devices) with pressure. When serving multiple clamping devices one ensures that more or less uniform operating conditions, as far as pressure is concerned, prevail at the served supports.

In a third embodiment thereof, the clamping device is made at least one element, preferably a bolt equipped with a flange, activated by an associated operating device. The operating device advantageously is a pressure producing element, preferably a spring element, having a direction of action. Preferably in the area of the flange thereof, the bolt can be activated by a recoil device having a direction of action which is opposite to the direction of action of the operating device. This clamping device has the clear advantage that, during utilization of the shaped part, no operating costs occur due to external activation of the operating device. The working mechanism is oriented opposite to the two aforementioned working mechanisms. To release the arrangement, merely a force must be applied through the recoil device. This embodiment of the clamping device results in advantages regarding operational safety, operability and various costs, i.e. maintenance costs.

In a fourth embodiment thereof, the clamping device is made at least one element, preferably a ball, activated by an associated operating device. The operating device advantageously is a pressure producing element, preferably a spring element, having a direction of action. An advantage with this clamping device is the low design considerations and the low acquisition and operating costs for the clamping device. The working mechanism further corresponds with that of the third clamping device, which offers various positive characteristics.

In order to be able to utilize the clamping device according to the invention in a paper, cardboard or tissue machine, it is made to be resistant to acid and alkaline process water, preferably in a range of pH 2.5 to pH 12.

In order to meet the aforementioned demand, the clamping device is made to be further resistant against all solvents and chemicals, for example 20% caustic soda lye, and is hydrolysis resistant, meaning it is greatly resistant to swelling.

The wear part of the arrangement in accordance with the invention consists of a ceramic material or a thermoplastic material, whereas the shaped part consists of at least one of a ceramic material; a duroplastic material, for example GFK; and of a thermoplastic material. The aforementioned material types have hitherto proven themselves suitable for operation in paper, cardboard or tissue machines.

In a further embodiment, the shaped part and the wear part are designed as one unit, consisting of the same material, for example, a ceramic material or a thermoplastic material. The single unit design creates the advantage that only one unit exists, the one unit being homogeneous and not conjoined by connecting elements, particularly gluing.

Based on operational demands, the support part of the arrangement consists preferably of at least one of stainless steel and a duroplastic material.

It is understood that the aforementioned characteristics of the invention, as well as those yet to be described below can be used not only in the cited combinations, but can be utilized in other combinations or on their own, without leaving the scope of the invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
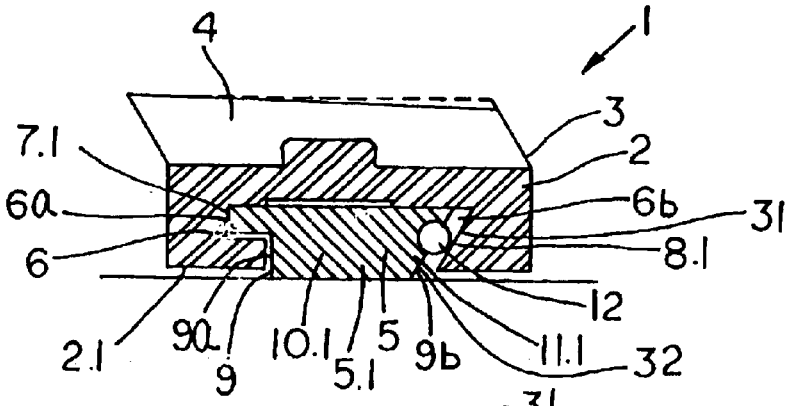
FIGS. 1 through 16 are cross-sectional view of various embodiments of the arrangement in accordance with the present invention.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

In accordance with the invention, shaped part 2 has a 2-part T-groove 7.1 representing an inside contour 6 extending along the entire length on under side 2.1 thereof on first side 6*a*, and a dovetail groove 8.1 made up of two halves representing an inside contour 6 on second side 6*b*, extending along the entire length of shaped part 2. Support piece 5, on upper side 5.1 and on first side 9*a* thereof, includes a 2-part T-rib 10.1 representing an outside contour 9 extending along the entire length thereof, and a dovetail rib 11.1 on second side 9*b* representing an outside contour 9, also extending along the entire length thereof. A preferably controllable clamping device 12 is located in the area of angled 2-part contour 13.1. Clamping device 12 however, can also be designed as a non-operable unit, for example, a spring clamp. The embodiment of FIG. 1 includes at least one shaped part angled surface 31 and at least one support piece angled surface 32. Both shaped part angled surface 31 and support piece angled surface 32 are nonparallel and nonperpendicular to the machine direction as viewed in cross-section. At least one clamping device is operatively positioned and in contact with each of at least one shaped part angled surface 31 and at least one support piece angled surface 32.

Figure 2:
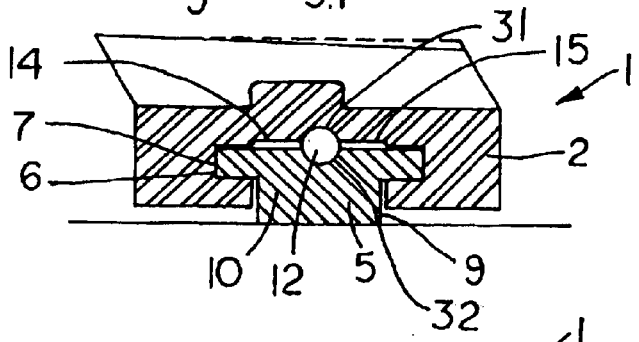

FIG. 2 shows a schematic cross section of a second embodiment of arrangement 1. According to the second embodiment, shaped part 2 has a T-groove 7 as an inside contour 6, advantageously with a recess 14 in grooved bottom 15, and support piece 5 has a T-rib 10 as outside contour 9. Clamping device 12 favorably is mounted in the center in the area of grooved bottom 15. The embodiment of FIG. 2 includes at least one shaped part angled surface 31 and at least one support piece angled surface 32. Both shaped part angled surface 31 and support piece angled surface 32 are nonparallel and nonperpendicular to the machine direction as viewed in cross-section. At least one clamping device is operatively positioned and in contact with each of at least one shaped part angled surface 31 and at least one support piece angled surface 32.

Figure 3:
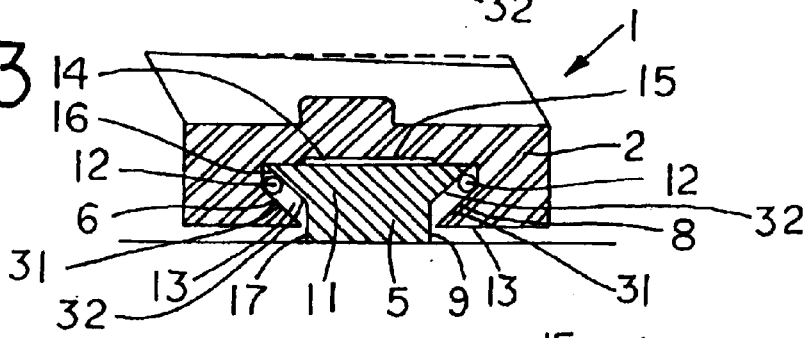

FIG. 3 shows a schematic cross section of a third embodiment of arrangement 1. According to the third embodiment, shaped part 2 has a dovetail groove 8, equipped with a parallel base 16 as inside contour 6 thereof, favorably with a recess 14 in grooved bottom 15, and support piece 5 has a dovetail rib 11 with a parallel base 17 as an outside contour 9. A clamping device 12 is installed on each side of angled dovetailed contours 13. The embodiment of FIG. 3 includes at least one shaped part angled surface 31 and at least one support piece angled surface 32. Both shaped part angled surface 31 and support piece angled surface 32 are nonparallel and nonperpendicular to the machine direction as viewed in cross-section. At least one clamping device is operatively positioned and in contact with each of at least one shaped part angled surface 31 and at least one support piece angled surface 32.

Figure 4:
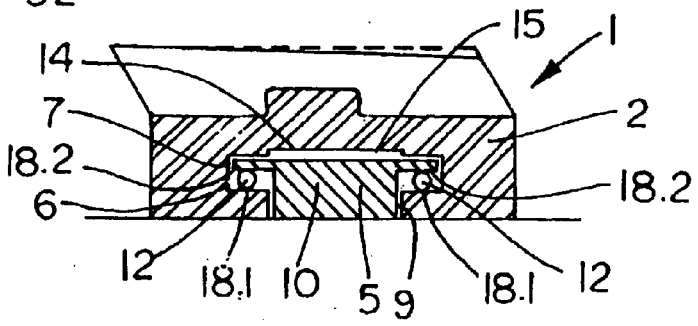

FIG. 4 shows a schematic cross section of a forth embodiment of arrangement. According to the fourth embodiment, shaped part 2 has a T-groove 7 as an inside contour 6, advantageously with a recess 14 in grooved bottom 15, and support piece 5 has a T-rib 10 as an outside contour 9. A clamping device 12 is installed on each side in the area of two opposing short face surfaces 18.1, 18.2.

Figure 5:
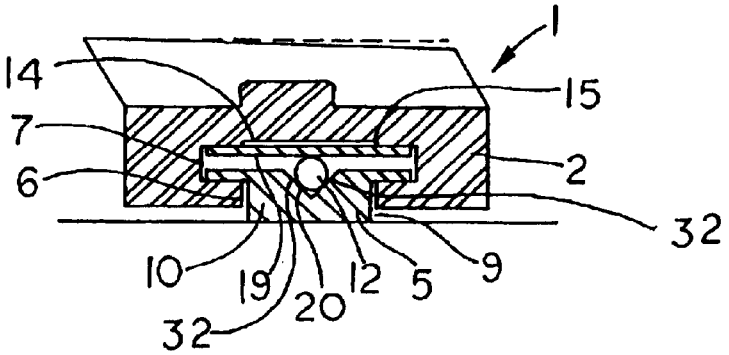

FIG. 5 shows a schematic cross section of a fifth embodiment of arrangement 1. According to the fifth embodiment, shaped part 2 has a T-groove 7 as an inside contour 6, favorably with a recess 14 in grooved bottom 15, and support piece 5 has a T-rib 10 with clamping rail 19 as an outer contour 9. Clamping device 12 is installed between T-rib 10 of support piece 5 and clamping rail 19, integrated preferably in a V-groove 20 which advantageously is centered on T-rib 10. The embodiment of FIG. 5 includes at least one support piece angled surface 32. Support piece angled surface 32 is nonparallel and nonperpendicular to the machine direction as viewed in cross-section. At least one clamping device is operatively positioned and in contact with at least one support piece angled surface 32.

Figure 6:
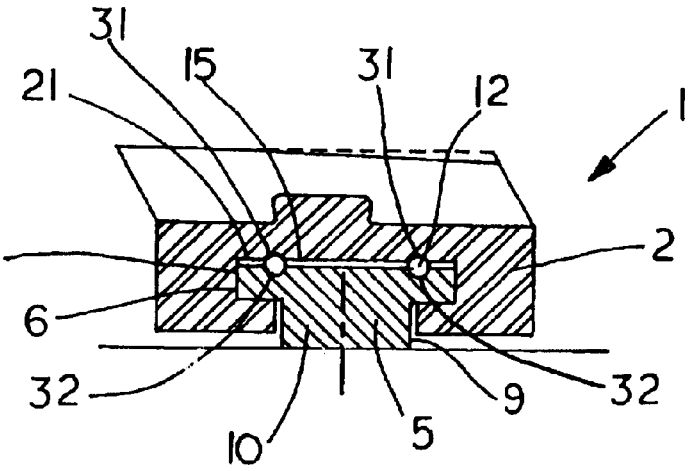

FIG. 6 shows a schematic cross section of a sixth embodiment of arrangement 1. According to the sixth embodiment, shaped part 2 has a T-groove 7 as an inside contour 6 and support piece 5 has a T-rib 10 as an outside contour 9. At least one clamping device 12 is installed between top side 21 of T-rib 10 and grooved bottom 15. The embodiment of FIG. 6 includes at least one shaped part angled surface 31 and at least one support piece angled surface 32. Both shaped part angled surface 31 and support piece angled surface 32 are nonparallel and nonperpendicular to the machine direction as viewed in cross-section. At least one clamping device is operatively positioned and in contact with each of at least one shaped part angled surface 31 and at least one support piece angled surface 32.

Figure 7:
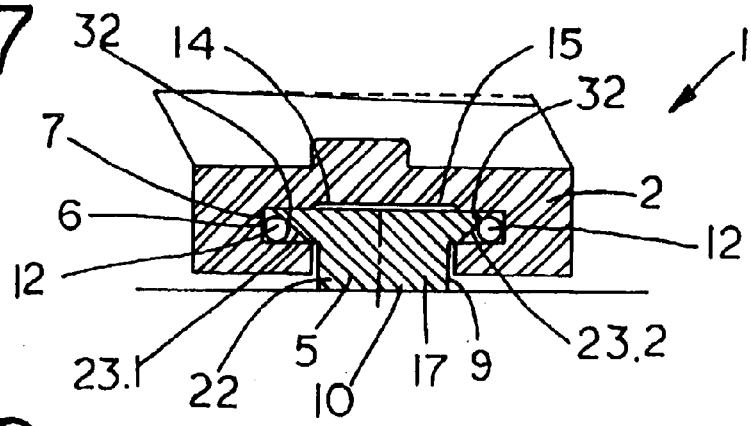

FIG. 7 shows a schematic cross section of a seventh embodiment of arrangement 1. According to the seventh embodiment, shaped part 2 has a T-groove 7 as an inside contour 6, advantageously with a recess 14 in grooved bottom 15, and support piece 5 has a T-rib 10 as an outside contour 9, with two side bevels 23.1, 23.2 progressing from T-rib bottom 22 toward the outside and with a parallel base 17. A clamping device 12 is installed in the areas of each of bevels 23.1, 23.2. The embodiment of FIG. 7 includes at least one support piece angled surface 32. Support piece angled surface 32 is nonparallel and nonperpendicular to the machine direction as viewed in cross-section. At least one clamping device is operatively positioned and in contact with at least one support piece angled surface 32.

Figure 8:
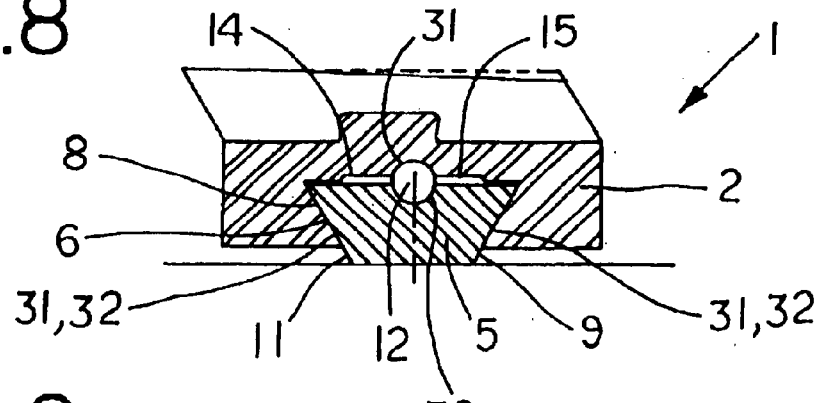

FIG. 8 shows a schematic cross section of an eighth embodiment of arrangement 1. According to the eighth embodiment, shaped part 2 has a dovetail groove 8 as an inside contour 6, favorably with a recess 14 in grooved bottom 15, and support piece 5 has a dovetail rib 11 as an outside contour 9. Clamping device 12 is advantageously installed so as to be centered in the area of grooved bottom 15. The embodiment of FIG. 8 includes at least one shaped part angled surface 31 and at least one support piece angled surface 32. Both shaped part angled surface 31 and support piece angled surface 32 are nonparallel and nonperpendicular to the machine direction as viewed in cross-section. At least one clamping device is operatively positioned and in contact with each of at least one shaped part angled surface 31 and at least one support piece angled surface 32.

Figure 9:
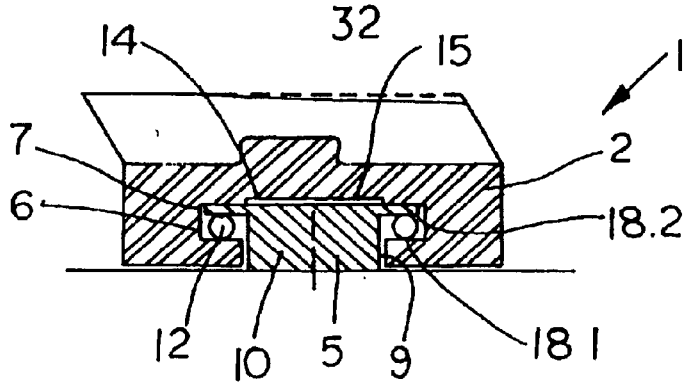

FIG. 9 shows a schematic cross section of a ninth embodiment of arrangement 1. According to the ninth embodiment, shaped part 2 has a T-groove 7 as an inside contour 6, advantageously with a recess 14 in grooved bottom 15, and support piece 5 has a T-rib 10 as an outside contour 9. A clamping device 12 is installed in the area of each of opposing short face areas 18.1, 18.2.

Figure 10:
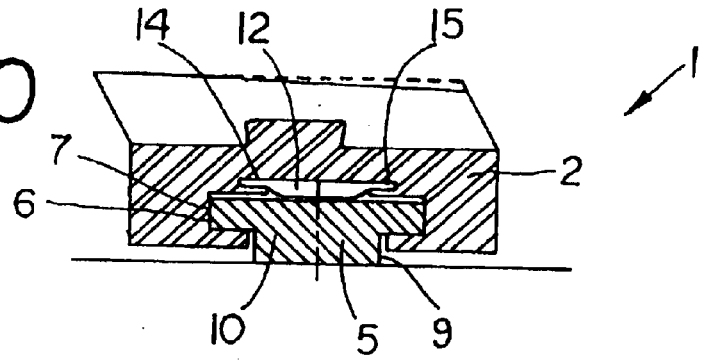

FIG. 10 shows a schematic cross section of a tenth embodiment of arrangement 1. According to the tenth embodiment, shaped part 2 has a T-groove 7 as an inside contour 6, whereby T-groove has a recess 14 in grooved bottom 15, and support piece 5 has a T-rib 10 as an outside contour 9. Clamping device 12 is installed in recess 14 in grooved bottom 15.

Figure 11:
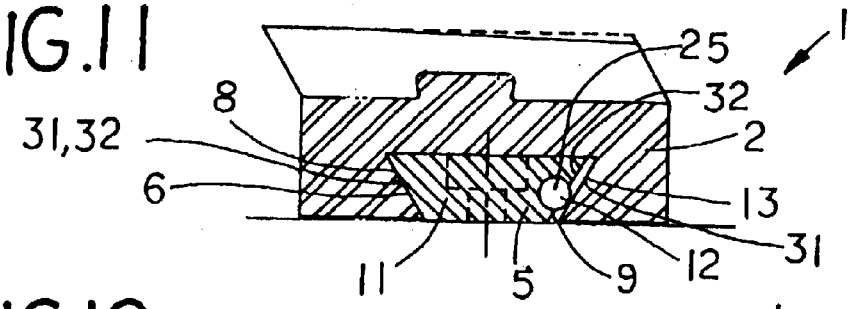

FIG. 11 shows a schematic cross section of an eleventh embodiment of arrangement 1. According to the eleventh embodiment, shaped part 2 has a dovetail groove 8 as an inside contour 6 and support piece 5 has a dovetail rib 11 as an outside contour 9. At least one pivoting clamping device 12, located primarily within support piece 5, is installed in the area of dovetail contours 13, which are angled on both sides. According to this embodiment, clamping device 12 is an eccentric 25 with an associated operating device, which is not separately illustrated here. The operating device can, for example, be a cam plate or an electric motor, and, since such operating devices are well known in the state of the art, they will not be described, or illustrated, in further detail in this instance. The embodiment of FIG. 11 includes at least one shaped part angled surface 31 and at least one support piece angled surface 32. Both shaped part angled surface 31 and support piece angled surface 32 are nonparallel and nonperpendicular to the machine direction as viewed in cross-section. At least one clamping device is operatively positioned and in contact with each of at least one shaped part angled surface 31 and at least one support piece angled surface 32.

Figure 12:
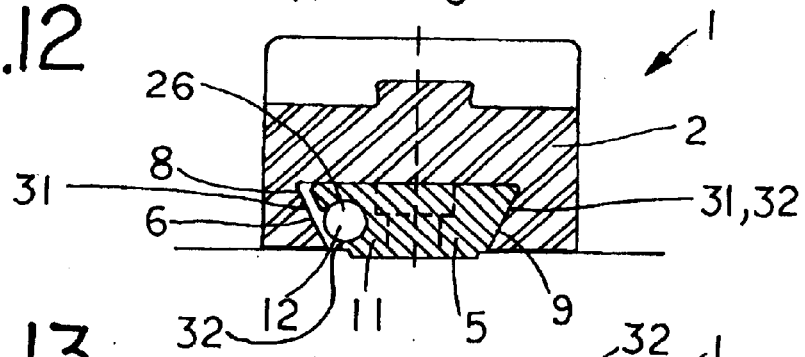

FIG. 12 shows a schematic cross section of a twelfth embodiment of arrangement 1. According to the twelfth embodiment, shaped part 2 has a dovetail groove 8 as an inside contour 6, and support piece 5 has a dovetail rib 11 as an outside contour 9. At least one expansive clamping device 12, located primarily in support piece 5, is installed in the area of dovetail contours 13, which are angled on both sides. According to this embodiment, clamping device 12 is an elastomer tube (e.g., "rubber tube") with a certain operating pressure, generally between 0.5 bar and 5 bar, preferably between 2 bar and 3.5 bar. The operating pressure is produced by a preferably central pressure source, already known in the state of the art and therefore not illustrated here, including a control system. Furthermore, the pressure source serves at least one clamping connection, favorably serving all clamping connections with pressure. When serving multiple clamping connections, one ensures that more or less uniform operating conditions, as far as pressure is concerned, prevail at the served supports. The embodiment of FIG. 12 includes at least one shaped part angled surface 31 and at least one support piece angled surface 32. Both shaped part angled surface 31 and support piece angled surface 32 are nonparallel and nonperpendicular to the machine direction as viewed in cross-section. At least one clamping device is operatively positioned and in contact with each of at least one shaped part angled surface 31 and at least one support piece angled surface 32.

Figure 13:
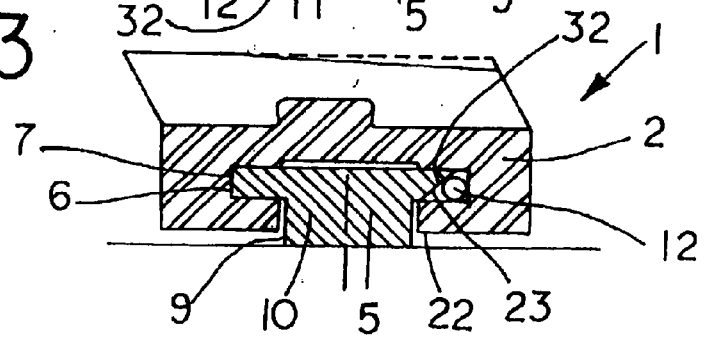

FIG. 13 shows a schematic cross section of a thirteenth embodiment of arrangement 1. According to the thirteenth embodiment, shaped part 2 has a T-groove 7 as an inside contour 6, and support piece 5 has a T-rib 10 as an outside contour 9 which has a bevel 23 on one side thereof, progressing from T-rib bottom 22 toward the outside. Clamping device 12 is installed in the area of bevel 23. The embodiment of FIG. 13 includes at least one support piece angled surface 32. Support piece angled surface 32 is nonparallel and nonperpendicular to the machine direction as viewed in cross-section. At least one clamping device is operatively positioned and in contact with at least one support piece angled surface 32.

Figure 14:
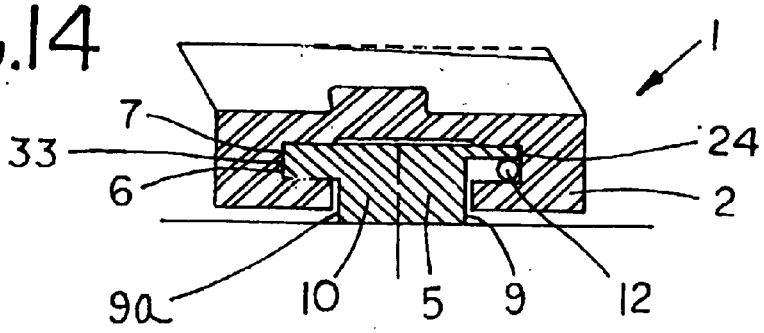

FIG. 14 shows a schematic cross section of a fourteenth embodiment of arrangement 1. According to the fourteenth embodiment, shaped part 2 has a T-groove 7 as an inside contour 6, and support piece 5 has a T-rib 10 as an outside contour 9 which on side 9*b* has a shorter root face 24 than root face 33 on the other side 9*a*. Clamping device 12 is installed in the area of shorter root face 24.

Figure 15:
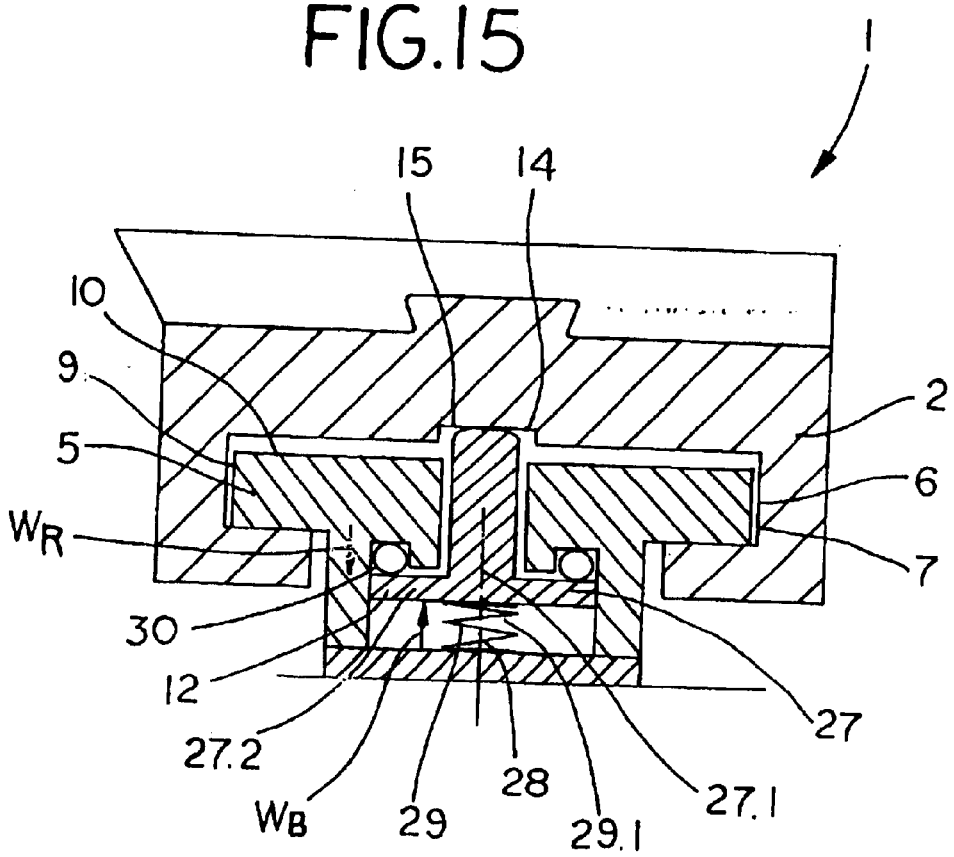

FIG. 15 shows a schematic cross section of a fifteenth embodiment of arrangement 1 According to the fifteenth embodiment, shaped part 2 has a T-groove 7 as an inside contour 6, favorably with a recess 14 at grooved bottom 15 and support part 5 has a T-rib 10 as an outside contour 9. Clamping device 12 is mounted and, advantageously, centered on T-rib 10 and will act upon T-groove 7, favorably in the area of grooved bottom 15. The invention provides that clamping device 12 is designed as at least as one element 27, preferably a bolt 27.1 equipped with a flange 27.2, and activated by an associated operating device 28. Operating device 28 is a pressure producing element 29, favorably a spring element 29.1, having a direction of action WB (arrow). In the area of flange 27.2 thereof, bolt 27.1 can be activated by a recoil device 30 having a direction of action WB (arrow) which is opposite to direction of action WB (arrow) of operating device 28. In accordance with the current state of the art, recoil device 28 may be a pressure-supplied elastomer tube or other similar element.

Figure 16:
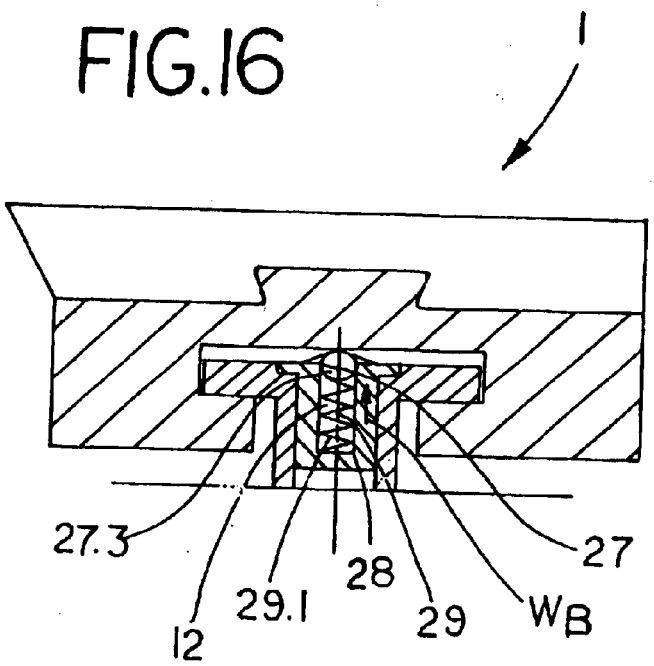

FIG. 16 shows a schematic cross section of a sixteenth embodiment of arrangement 1. Arrangement 1 is similar to that in FIG. 15 to which we will herewith refer. According to the sixteenth embodiment, clamping device 12 is at least one element 27, advantageously a ball 27.3, activated by an associated operating device 28. Operating device 28 is favorably a pressure producing element 29, advantageously a spring element 29.1, having a direction of action $W_B$ (arrow).

The embodiments in FIGS. 15 and 16 could naturally also assume the embodiments of the prior Figures. For example, shaped part 2 could be equipped with a dovetail groove 8, and support piece 5 could be equipped with a dovetail rib 11. In principle, all described arrangements 1 are possible also for FIGS. 15 and 16.

All illustrated clamping devices 12, according to the invention, are advantageously resistant to acid and alkaline process water, preferably in a range of pH 2.5 to pH 12, as well as to all solvents and chemicals, for example 20% caustic soda lye. They are also favorably hydrolysis resistant, meaning they are greatly resistant to swelling, in order to be able to utilize them in a paper, cardboard or tissue machine.

According to the invention, a possible embodiment is one in which shaped part 2 and wear part 4 are constructed integrally as one unit, manufactured from the same material, for example, an oxide ceramic.

In the method according to the invention, two parts 2, 5 are clamped to each other using a clamping device 12, so that an operating tolerance is vastly or, preferably, totally eliminated, based on manufacturing tolerances. Additionally, a quick and non-destructive change-over of shaped part 2 is possible, and a common sealing of parts 2, 5 is possible so that no fiber-loaded and/or dirt-loaded processing water can penetrate between them.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

1 Arrangement
2 Shaped part
2.1 Underside
3 Top surface
4 Wear part
5 Support piece
5.1 Top side
6 Inside contour
6.1 Contour
6*a*, 9*a* First side
6*b*, 9*b* Second side
7 T-groove
7.1 2-part groove
8 Dovetail groove
8.1 2-part dovetail groove
9 Outside contour
9.1 Contour
10 T-groove
10.1 2-part T-groove
11 Dovetail rib
11.1 2-part dovetail rib
12 Clamping device
13 Dovetail contour
13.1 2-part dovetail contour
14 Recess
15 Grooved bottom
16,17 Base
18.1, 18.2 Face
19 Clamping rail
20 V-groove
21 Top side
22 T-rib bottom
23, 23.1, 23.2 Bevel
24 Root face
25 Eccentric
26 Elastomer tube
27 Element
7.1 Bolt
27.2 Flange
27.3 Ball
28 Operating device
29 Pressure producing element
29.1 Spring element
30 Recoil device

What is claimed is:

1. A method of attaching a first unit onto a support piece, said first unit being a portion of a machine for processing at least one of paper, cardboard and tissue, said first unit including a shaped part and a wear part, the machine having a machine direction, comprising the steps of:

interlocking said shaped part and said support piece, said shaped part having at least one shaped part angled surface, said at least one shaped part angled surface both nonparallel and nonperpendicular to the machine direction, said support piece having at least one support piece angled surface, said at least one support piece angled surface both nonparallel and nonperpendicular to said machine direction;

providing a clamping device in contact with each of said at least one shaped part angled surface and said at least one support piece angled surface; and clamping said shaped part and said support piece together using said clamping device, said clamping step providing clamping in both said machine direction and orthogonal to said machine direction, thereby clamping said shaped part and said support piece in a manner such that an operating tolerance therebetween is at least substantially eliminated, that a quick and non-destructive change-over of said shaped part and that a common sealing between said shaped part and said support piece results, said common sealing essentially preventing both fiber-loaded and dirt-loaded processing water from penetrating between said shaped part and said support piece.

2. The method of claim 1, wherein said first unit is one of a dewatering strip, deflector and slotted suction unit.

3. The method of claim 1, wherein clamping is achieved in a manner such that vibrations are substantially eliminated, said clamping thereby effecting oscillation dampening.

4. The method of claim 1, wherein said first unit is a foil deflector having an associated angular position, said clamping being achieved in a manner such that said angular position of said foil deflector effectively remains constant during said clamping step.

5. An arrangement for use within a machine for at least one of making and processing at least one of paper, cardboard and tissue, the machine having a machine direction, said arrangement comprising:

a first unit having a shaped part together with a wear part, said shaped part having a part underside, said part underside having an underside length, said shaped part displaying a part contour upon said part underside along substantially all of said underside length, said part contour including at least one shaped part angled surface, said at least one shaped part angled surface both nonparallel and nonperpendicular to the machine direction;

a support piece interlocking with said shaped part, said support piece having a support piece top and a corresponding top length, said support piece having a piece contour upon said support piece top along substantially all of said top length, said piece contour being substantially complimentary to said part contour, said piece contour including at least one support piece angled surface, said at least one support piece angled surface both nonparallel and nonperpendicular to the machine direction; and at least one clamping device operatively positioned and in contact with each of said at least one shaped part angled surface and said at least one support piece angled surface at least one said clamping device providing clamping in both said machine direction and orthogonal to said machine direction.

6. The arrangement of claim 5, wherein said first unit is one of a dewatering strip, a deflector, and a slotted suction unit.

7. The arrangement of claim 5, wherein said part contour is an inside contour within said shaped part, said piece contour being an outside contour of said support piece.

8. The arrangement of claim 7, said inside contour including a two-part T-groove on a first side of said shaped part, said inside contour further including a two-part dovetail groove on a second side of said shaped part, said outside contour including a two-part T-rib on a first side of said support piece, said outside contour further including a dovetail rib on a second side of said support piece, one said clamping device being located proximate said two-part dovetail groove and said dovetail rib.

9. The arrangement of claim 7, wherein said inside contour includes a T-groove, said outside contour including a T-rib.

10. The arrangement of claim 9, wherein said T-groove has a grooved bottom, said grooved bottom having a recess therein, said clamping device being mounted substantially centrally relative to said grooved bottom.

11. The arrangement of claim 7, wherein said shaped part has a dovetail groove, said inside contour including a first parallel base, said support piece having a dovetail rib, said outside contour including a second parallel base, said clamping device being installed adjacent to both said dovetail groove and said dovetail rib.

12. The arrangement of claim 11, wherein said inside contour includes a grooved bottom, said grooved bottom having a recess therein.

13. The arrangement of claim 7, wherein said inside contour includes a T-groove, said T-groove having a first groove face and a second groove face associated therewith, said outside contour including a T-rib, said T-rib having a first rib face and a second rib face associated therewith, said at least one clamping device including a first clamping device and a second clamping device, said first groove face opposing said first rib face with said first clamping device installed therebetween, said second groove face opposing said second rib face with said second clamping device installed therebetween.

14. The arrangement of claim 7, wherein said inside contour includes a T-groove, said outside contour including a T-rib, said inside contour including a grooved bottom, said grooved bottom having a recess therein.

15. The arrangement of claim 7, wherein said inside contour includes a T-groove, said inside contour having a clamping rail associated therewith, said outside contour including a T-rib, said clamping device being positioned between said T-rib and said clamping rail.

16. The arrangement of claim 15, wherein said T-rib has a V-groove substantially centered thereon, said clamping device being positioned in said V-groove.

17. The arrangement of claim 7, wherein said inside contour includes a T-groove, said inside contour including a grooved bottom, said outside contour including a T-rib, said T-rib having a rib top side, said at least one clamping device being installed between said rib top side and said grooved bottom.

18. The arrangement of claim 7, wherein said inside contour includes a T-groove, said outside contour including a T-rib, said T-rib having a parallel base and a first bevel side and a second bevel side, said first bevel side and said second bevel side each progressing from a respective T-rib bottom toward an outside of said T-rib, said at least one clamping device including a first clamping device and a second clamping device, said first clamping device being positioned adjacent said first bevel side, said second clamping device being positioned adjacent said second bevel side.

19. The arrangement of claim 7, wherein said inside contour includes a dovetail groove, said inside contour including a grooved bottom, said outside contour including a dovetail rib, said clamping device being installed substantially centered in said grooved bottom.

20. The arrangement of claim 7, wherein said inside contour includes a dovetail groove, said inside contour including a grooved bottom, said grooved bottom having a recess therein.

21. The arrangement of claim 7, wherein said inside contour includes a T-groove, said outside contour including a T-rib, said inside contour including a grooved bottom, said grooved bottom having a recess therein, said clamping device being installed in said recess.

22. The arrangement of claim 7, wherein said inside contour includes a dovetail groove, said dovetail groove having a first angled groove surface and an opposed second angled groove surface associated therewith, said outside groove including a dovetail rib, said dovetail rib having a first angled rib surface and a second angled rib surface associated therewith, said first angled rib surface and said first angled groove surface forming a first contour set, said second angled rib surface and said second angled groove surface forming a second contour set, each said clamping device being a pivoting clamping device, each said pivoting clamping device being located in said support piece between one of said first contour set and said second contour set.

23. The arrangement of claim 7, wherein said inside contour includes a dovetail groove, said dovetail groove having a first angled groove surface and an opposed second angled groove surface associated therewith, said outside groove including a dovetail rib, said dovetail rib having a first angled rib surface and a second angled rib surface associated therewith, said first angled rib surface and said first angled groove surface forming a first contour set, said second angled rib surface and said second angled groove surface forming a second contour set, each said clamping device being an expansive clamping device, each said expansive clamping device being located in said support piece between one of said first contour set and said second contour set.

24. The arrangement of claim 7, wherein said inside contour includes a T-groove, said outside contour including a T-rib, said T-rib having a rib bevel side, said rib bevel side progressing from a respective T-rib bottom toward the respective outside of said T-rib, said clamping device being positioned proximate said rib bevel side.

25. The arrangement of claim 7, wherein said inside contour includes a T-groove, said outside contour including a T-rib, said clamping device being mounted substantially centered on said T-rib, said clamping device being configured for acting upon said T-groove.

26. The arrangement of claim 25, wherein said T-groove has a grooved bottom, said clamping device being configured for acting upon said T-groove in a region of said grooved bottom.

27. The arrangement of claim 5, wherein at least one said clamping device is an eccentric with a related operating device.

28. The arrangement of claim 5, wherein at least one said clamping device is an elastomeric tube having a certain operating pressure.

29. The arrangement of claim 28, wherein the operating pressure is in the approximate range of 0.5 bar to 5 bar.

30. The arrangement of claim 29, wherein the operating pressure is in the approximate range of 2 bar to 3.5 bar.

31. The arrangement of claim 28, wherein the operating pressure is produced by one pressure source.

32. The arrangement of claim 31, wherein said one pressure source supplies at least one clamping device with pressure.

33. The arrangement of claim 32, wherein said one pressure source supplies all of said clamping devices with pressure.

34. The arrangement of claim 5, wherein at least one said clamping device is a bolt element, said bolt element having a flange and being activated by an associated operating device.

35. The arrangement of claim 34, wherein said associated operating device is a pressure producing element having an operating direction of action associated therewith.

36. The arrangement of claim 35, wherein said pressure producing element is a spring element.

37. The arrangement of claim 5, wherein at least one said clamping device is at least one ball element, each said ball element being activated by an associated operating device.

38. The arrangement of claim 34, wherein said associated operating device is a pressure producing element having an operating direction of action associated therewith.

39. The arrangement of claim 35, wherein said pressure producing element is a spring element.

40. The arrangement of claim 5, wherein said clamping device is resistant to process water which is one of alkaline and acidic.

41. The arrangement of claim 40, wherein the process water has a pH in the approximate range of 2.5 to 12.

42. The arrangement of claim 5, wherein at least one said clamping device is resistant to all solvents and chemicals.

43. The arrangement of claim 5, wherein at least one said clamping device is hydrolysis resistant and is thereby resistant to swelling.

44. The arrangement of claim 5, wherein said wear part consists essentially of one of a ceramic material, a thermoplastic material and a composite of said ceramic material and said thermoplastic material.

45. The arrangement of claim 5, wherein said shaped part consists essentially of one of a ceramic material, a duroplastic material, a thermoplastic material and a composite of at least two of said ceramic material, said duroplastic material and said thermoplastic material.

46. The arrangement of claim 5, wherein said shaped part and said wear part are designed as one combined unit, said combined unit being composed of one material, said material being one of a ceramic and a thermoplastic.

47. The arrangement of claim 5, wherein said support piece consists of one of stainless steel and a duroplastic material.

48. An arrangement for use within a machine for at least one of making and processing at least one of paper, cardboard and tissue, said arrangement comprising:

a first unit having a shaped part together with a wear part, said shaped part having a part underside, said part underside having an underside length, said shaped part displaying a part contour upon said part underside along substantially all of said underside length;

a support piece interlocking with said shaped part, said support piece having a support piece top and a corresponding top length, said support piece having a piece contour upon said support piece top along substantially all of said top length, said piece contour being substantially complimentary to said part contour, said part contour is an inside contour within said shaped part, said piece contour being an outside contour of said support piece; and at least one clamping device operatively positioned and in contact with each of said part contour and said piece contour, said inside contour includes a T-groove, said outside contour including a T-rib, said T-rib having a first root face and a second root face on opposing sides thereof, said first root face being shorter than said second root face, said clamping device being positioned proximate said first root face.

49. An arrangement for use within a machine for at least one of making and processing at least one of paper, cardboard and tissue, said arrangement comprising:

a first unit having a shaped part together with a wear part, said shaped part having a part underside, said part underside having an underside length, said shaped part displaying a part contour upon said part underside along substantially all of said underside length;

a support piece interlocking with said shaped part, said support piece having a support piece top and a corresponding top length, said support piece having a piece contour upon said support piece top along substantially all of said top length, said piece contour being substantially complimentary to said part contour;

at least one clamping device operatively positioned and in contact with each of said part contour and said piece contour, at least one said clamping device is a bolt element, said bolt element having a flange and being activated by an associated operating device, said associated operating device is a pressure producing element having an operating direction of action associated therewith; and a recoil device, said recoil device being operatively positioned against said flange, said recoil device having a recoil direction associated therewith, said recoil direction being opposite said operating direction of action of said associated operating device, said recoil device being configured for activating said associated bolt element.

50. An arrangement for use within a machine for at least one of making and processing at least one of paper, cardboard and tissue, said arrangement comprising:

a first unit having a shaped part together with a wear part, said shaped part having a part underside, said part underside having an underside length, said shaped part displaying a part contour upon said part underside along substantially all of said underside length;

a support piece interlocking with said shaped part, said support piece having a support piece top and a corresponding top length, said support piece having a piece contour upon said support piece top along substantially all of said top length, said piece contour being substantially complimentary to said part contour, said support piece having a T-rib with an outside contour having a first side with a first root face and a second side with a second root face, said second root face shorter than said first root face; and at least one clamping device operatively positioned and in contact with both said part contour and said second side.

* * * * *

UNITED STATES PATENT AND TRADEMARK OFFICE

CERTIFICATE OF CORRECTION

PATENT NO. : 6,746,576 B2
DATED : June 8, 2004
INVENTOR(S) : Halmschlager et al.

It is certified that error appears in the above-identified patent and that said Letters Patent is hereby corrected as shown below:

Column 8,
Between lines 58 and 59, please insert the following paragraph:
-- In addition, total avoidance of dirt penetration into clamping device 12 is achieved in that the mutual sealing of the two parts (support piece 5 and shaped part 2) is achived by clamping device 12, specifically an elastomer tube 26 on the one hand, and positive locking of support piece 5 and shaped part 2 on the other hand. In other words, penetration of dirt or similar contaminants, especially from below, is avoided on the one side through sealing by elastomer tube 26. On the opposite side, the lower edge of support piece 5 is pressed onto shaped part 2, thereby also achieving a sealing effect. This type of sealing prevents penetration of fibers and/or process water into unit 1. --

Column 9,
Line 24, please delete "WB", and substitute therefore -- $W_B$ --; and
Line 27, please delete both instances of "WB," and substitute therefore -- $W_B$ --.

Signed and Sealed this

Twenty-second Day of February, 2005

JON W. DUDAS
*Director of the United States Patent and Trademark Office*